US007350452B2

(12) United States Patent
Plumier et al.

(10) Patent No.: US 7,350,452 B2
(45) Date of Patent: Apr. 1, 2008

(54) FIREARM WITH IMPROVED SALVO ACCURACY AND SIMILAR DEVICE FOR A FIREARM

(75) Inventors: Philippe Plumier, Alleur (BE); Charles Demoulin, Mons (BE); Guiseppe Librici, Jupille (BE)

(73) Assignee: FN Herstal S.A., Herstal (BE)

( * ) Notice: Subject to any disclaimer, the term of this patent is extended or adjusted under 35 U.S.C. 154(b) by 81 days.

(21) Appl. No.: 11/338,765

(22) Filed: Jan. 25, 2006

(65) Prior Publication Data

US 2006/0260460 A1 Nov. 23, 2006

(30) Foreign Application Priority Data

Jan. 27, 2005 (BE) ..... 2005/0049

(51) Int. Cl.
*F41A 25/22* (2006.01)

(52) U.S. Cl. ..... 89/37.03; 89/42.01

(58) Field of Classification Search .... 89/37.01–37.04, 89/37.07, 37.09, 37.13, 37.16, 37.19, 41.16, 89/42.01, 1.7; 42/1.06
See application file for complete search history.

(56) References Cited

U.S. PATENT DOCUMENTS 43,330 A * 6/1864 Newman ..... 89/37.01
640,051 A * 12/1899 Tower ..... 89/37.09
2,093,169 A * 9/1937 Holek ..... 89/159
2,279,601 A * 4/1942 Trotter ..... 89/37.03
2,433,637 A * 12/1947 Trotter ..... 89/42.01
2,490,787 A * 12/1949 Dixon ..... 89/198
3,207,037 A 9/1965 Pachmayr et al.
3,418,880 A * 12/1968 Herlach ..... 89/42.01
3,425,318 A * 2/1969 Whitehill ..... 89/42.01
3,504,594 A 4/1970 Greeley
3,672,255 A * 6/1972 Findlay et al. ..... 89/42.01
4,638,714 A * 1/1987 Heintz et al. ..... 89/37.01
H0202 H * 2/1987 Geeter ..... 89/14.05
4,672,881 A * 6/1987 Betts et al. ..... 89/1.816
5,056,410 A * 10/1991 Pitts ..... 89/37.04
5,155,292 A 10/1992 Rostcil et al.
6,401,592 B1 6/2002 Rostocil

* cited by examiner

*Primary Examiner*—Bret Hayes
(74) *Attorney, Agent, or Firm*—Bacon & Thomas, PLLC

(57) ABSTRACT

A fire arm with improved salvo accuracy, having a barrel and a casing mounted on a supporting frame, whereby the frame comprises a cradle provided with a slide which can slide in a direction which is mainly parallel to the axis of the barrel. The casing is mounted on the slide of the cradle on a transversal hinge pin, and on the frame via at least one shoe mounted in a sliding guide provided in the frame. The sliding guide is inclined in relation to the direction of the axis of the barrel at rest.

14 Claims, 4 Drawing Sheets

FIREARM WITH IMPROVED SALVO ACCURACY AND SIMILAR DEVICE FOR A FIREARM

BACKGROUND

The invention concerns a fire arm with improved salvo accuracy.

In particular, the invention concerns a fire arm of the machine-gun type which can fire by bursts, whereby the fire arm comprises a barrel and a casing mounted on a supporting frame, whereby the frame comprises a cradle provided with a slide which can slide in a direction which is mainly parallel to the axis of the barrel, whereby the casing is mounted on the slide of the cradle by means of a transversal hinge pin on the one hand, and on the frame by means of at least one shoe mounted in a sliding guide provided in the frame on the other hand.

The arm can be mounted with its frame on a tripod, on a remote-controlled turret or any other support whatsoever.

The casing and the barrel can move in the axial direction of the barrel, whereby the casing is supported by the slide of the cradle and by the shoe which is held in the sliding guide of the frame which, in the case of the known arms, is parallel to the axis of the barrel.

In rest, the slide of the cradle is maintained in an intermediary position by means of a spring or several springs.

While firing, the slide and the shoe allow for a guided recoil of the arm through the effect of the reactive forces of the propulsion gases of the ammunition that is being fired, and the spring or springs, either or not assisted by one or several shock absorbers, make it possible to dampen the axial to-and-fro movement of the casing while firing by bursts, and to stabilize the position of the casing around an average axial position.

The hinge pin of the casing on the frame allows the casing and the barrel to tilt.

When firing by bursts, the first shot is fired in the rest position of the arm, as when firing shot by shot, and the arm recoils due to the impulse of the first shot.

Immediately after the first shot and during the following shots, the barrel puts itself in position as the mobile elements of the arm and the interface elements such as the shoe connect again, and it puts itself in an average raised and diverted position around which the barrel oscillates through the effect of the successive shots.

Said oscillation of the barrel contributes to the dispersion of the firing impacts around an average point of impact which forms the centre in which the impacts of the successive shots come together at the first salvo.

In the case of the known fire arms we observe a deviation between the initial point of impact of the first shot and the average point of impact of the successive shots, which is translated in a diminished shooting accuracy, as all the salvos are taken into account, including the first shot.

SUMMARY

The invention aims to remedy the above-mentioned and other disadvantages and to provide a fire arm with improved salvo accuracy, which makes it possible to correct and compensate for the deviation between the initial point of impact of the first shot and the average point of impact of the successive shots.

This aim is reached according to the invention with a fire arm of the above-described type, but in which the sliding guide of the shoe of the casing is not parallel to the axis of the barrel, but is inclined in relation to the direction of this axis when in rest.

When firing a salvo, the barrel and the casing recoil and they tend to redress themselves as the elements connect again.

Since the shoe of the casing is guided by an inclined sliding guide, the recoil of the casing will make the casing swivel around the hinge pin so as to take the barrel back to its initial rest position, which is translated in that the average point of impact of the shots fired after the first shot comes close to the initial point of impact of the first shot, and thus in a salvo with improved accuracy.

According to a preferred embodiment, the fire arm comprises at least two sliding guides, each containing a casing shoe, whereby the dimensions of these sliding guides are such that a recoil of the casing and the barrel on the frame is translated in an inclined swiveling of the barrel and the casing around its transversal hinge pin and by a lateral swiveling around an axis which is perpendicular or mainly perpendicular to the transversal hinge pin and the axis of the barrel.

Thus, it is possible to compensate for the deviation between the initial point of impact of the first shot and the average point of impact of the following shots in two perpendicular planes, for example the vertical plane and the horizontal plane, such that said deviation can be eliminated completely.

The invention also concerns a device to improve the salvo accuracy for a fire arm, whereby the device comprises a fixing element for the fire arm which is mounted on a supporting frame which comprises a cradle provided with a slide which can slide in a longitudinal direction parallel to the axis of the barrel, whereby the fixing element is mounted on the slide of the cradle by means of a transversal hinge pin on the one hand and on the frame by means of at least one shoe mounted in a sliding guide provided in the frame, whereby said sliding guide is inclined in relation to said longitudinal direction.

BRIEF DESCRIPTION OF THE DRAWINGS

In order to better explain the characteristics of the invention, an example of an embodiment of a known fire arm and of a fire arm according to the invention with improved salvo accuracy are given as an example only without being limitative in any way, with reference to the accompanying drawings, in which.

DETAILED DESCRIPTION OF THE EMBODIMENTS

Figure 1:
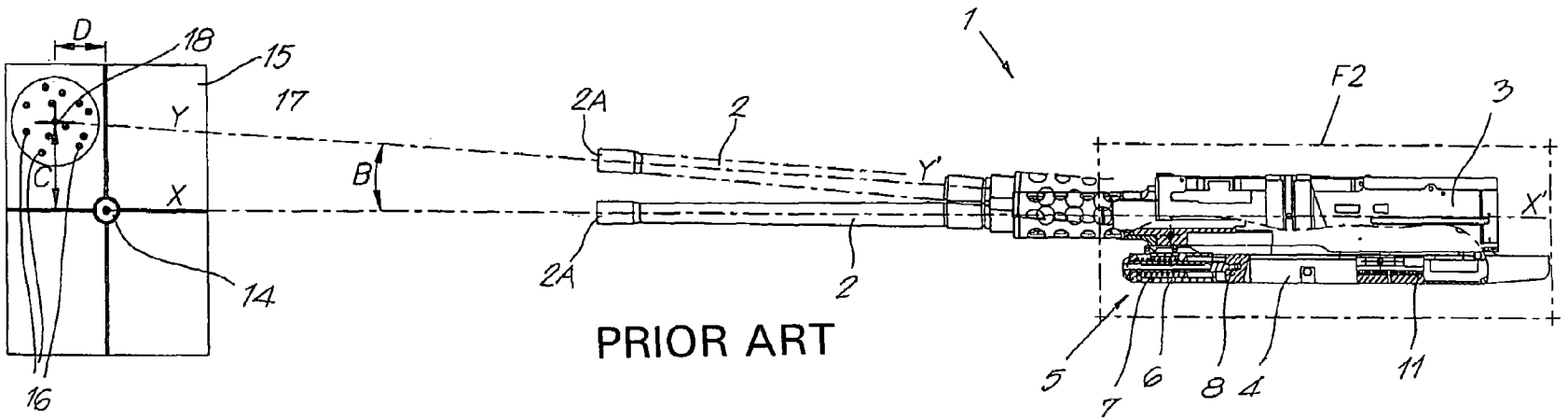
PRIOR ART Fig.1
FIG. 1 is a schematic side view of a known fire arm, a part of which is represented as a vertical section.

FIG. 1 represents a known fire arm 1, in particular a machine-gun which can fire by bursts.

This known fire arm 1 comprises a barrel 2 and a casing 3 mounted on a supporting frame 4, whereby the frame comprises an elastic cradle 5 provided with a slide 6 which can slide in the supporting frame 4 according to a direction which is mainly parallel to the geometric axis X-X' of the barrel 2 in rest.

The slide 6 is maintained in a free intermediary position by means of return spring 7 in such a manner that the slide can move towards the front as well as to the rear.

The frame 4 also comprises one or two shock absorbers 8 to dampen the movement of the slide 6 of the cradle 5.

The casing 3 is hinge-mounted between two parallel, spaced-apart ears 9 of the slide 6 of the cradle 5 by means of a transversal hinge pin 10 on the one hand.

On the other hand, the casing 3 is supported by the frame 4 by means of a shoe 11 mounted in a sliding guide 12 which is part of the frame and which is limited by two guiding walls 13 which are parallel to the axis X-X' of the barrel in rest.

In a general manner, there are two shoes 11 sliding in two sliding guides at a distance from the hinge pin 10 of the casing 4.

The working of the fire arm 1 is well known.

When a first salvo is fired, the barrel is situated in its rest position, with its axis directed according to axis X-X'.

The point of impact of the first shot, called the initial point of impact, is schematically represented by point 14 on the target 15 in FIG. 1.

When the following shots of the salvo are fired, the barrel 2 and the casing 3 recoil backwards due to the propulsion gases of the fired ammunition, while being supported by the slide 6 and by the shoes 11 which allow for a movement in the direction of the axis of the barrel X-X' in rest.

During the firing, the barrel 2 and the casing 3 oscillate around an average recoiled position M, characterized by a movement A in relation to their rest position, whereby this oscillating movement is either or not dampened and stabilized through the action of the return spring 7 or springs and the shock absorber or shock absorbers 8.

Simultaneously, the barrel 2 and the casing 3 redress themselves through the action of the propulsion gases as the elements connect again, i.e. the mobile elements of the fire arm 1 and the interface elements such as the shoes 11 in the sliding guides 12.

The barrel 2 oscillates in a rotating manner around an average direction Y-Y' which forms an angle B with the rest direction X-X'.

The dynamics of this firing by bursts explains why the impacts 16 of the successive shots at the first salvo come together in a zone 17 whose center is called the average point of impact 18, which is situated at a distance C above an initial point of impact 14.

As the mobile elements of the fire arm 1 connect again, not only the barrel 2 redresses itself, but also the muzzle 2A of the barrel 2 is laterally shifted, which results in a shifting D of the average point of impact 18 in relation to the initial point of impact 14.

The divergence between the average point of impact 18 and the initial point of impact 14 is translated in a less accurate salvo.

FIGS. 3 to 7 show an improved fire arm 19 according to the invention which resembles the fire arm 1 of FIG. 1, but in which the shoes 11 of the casing 3 are mounted in first sliding guides 12 which are such that a recoil of the casing 3 is translated in a swiveling of the casing 3 and the barrel 2 around the hinge pin 10 of the casing 3.

Figure 4:
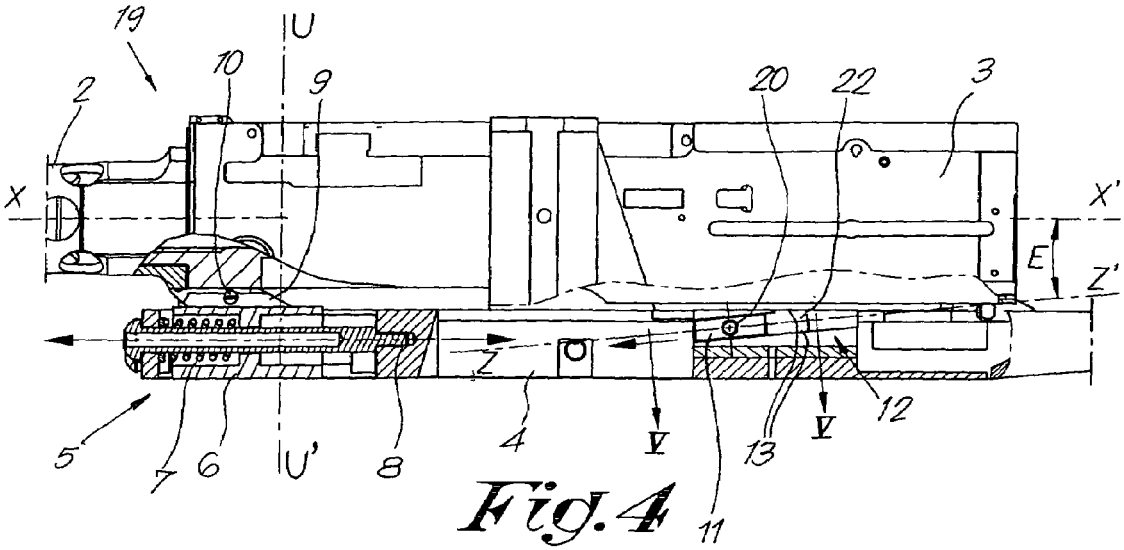
FIG. 4 represents the part indicated by F4 in FIG. 3 to a larger scale.

To this end, the first sliding guides 12 are inclined in relation to the direction X-X' of the axis of the barrel 2 in rest, in other words the guiding walls 13 of the first sliding guides 12 form an angle E with the axis X-X' as represented in FIG. 4, in such a manner that the guiding direction Z-Z' of the first sliding guides 12 is situated in a plane which is perpendicular to the hinge pin 10 of the casing 3.

Figure 3:
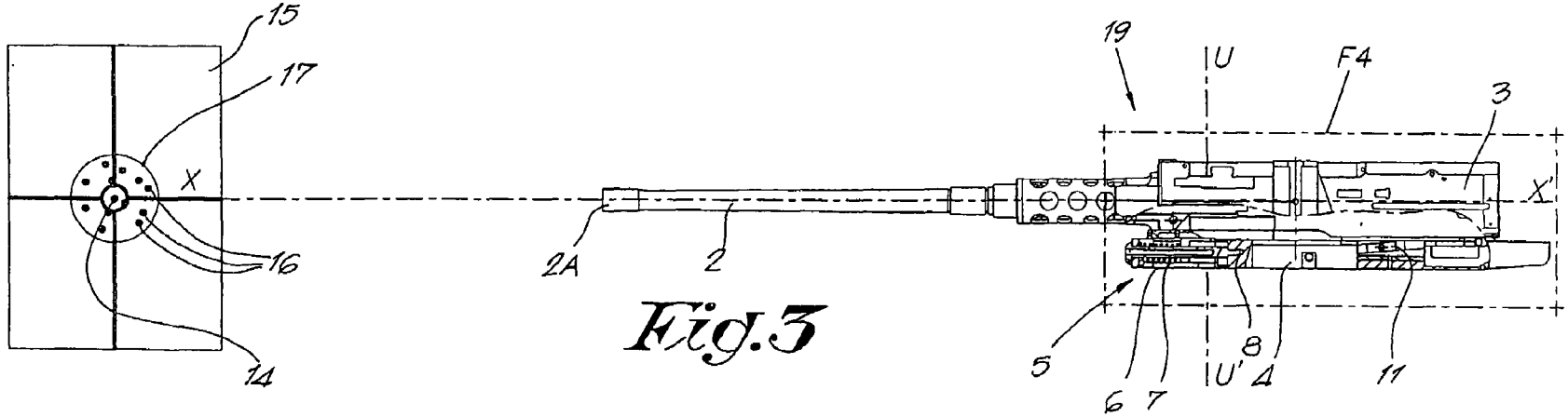
FIG. 3 is a view similar to that in FIG. 1, but for a fire arm according to the invention.
Figure 2:
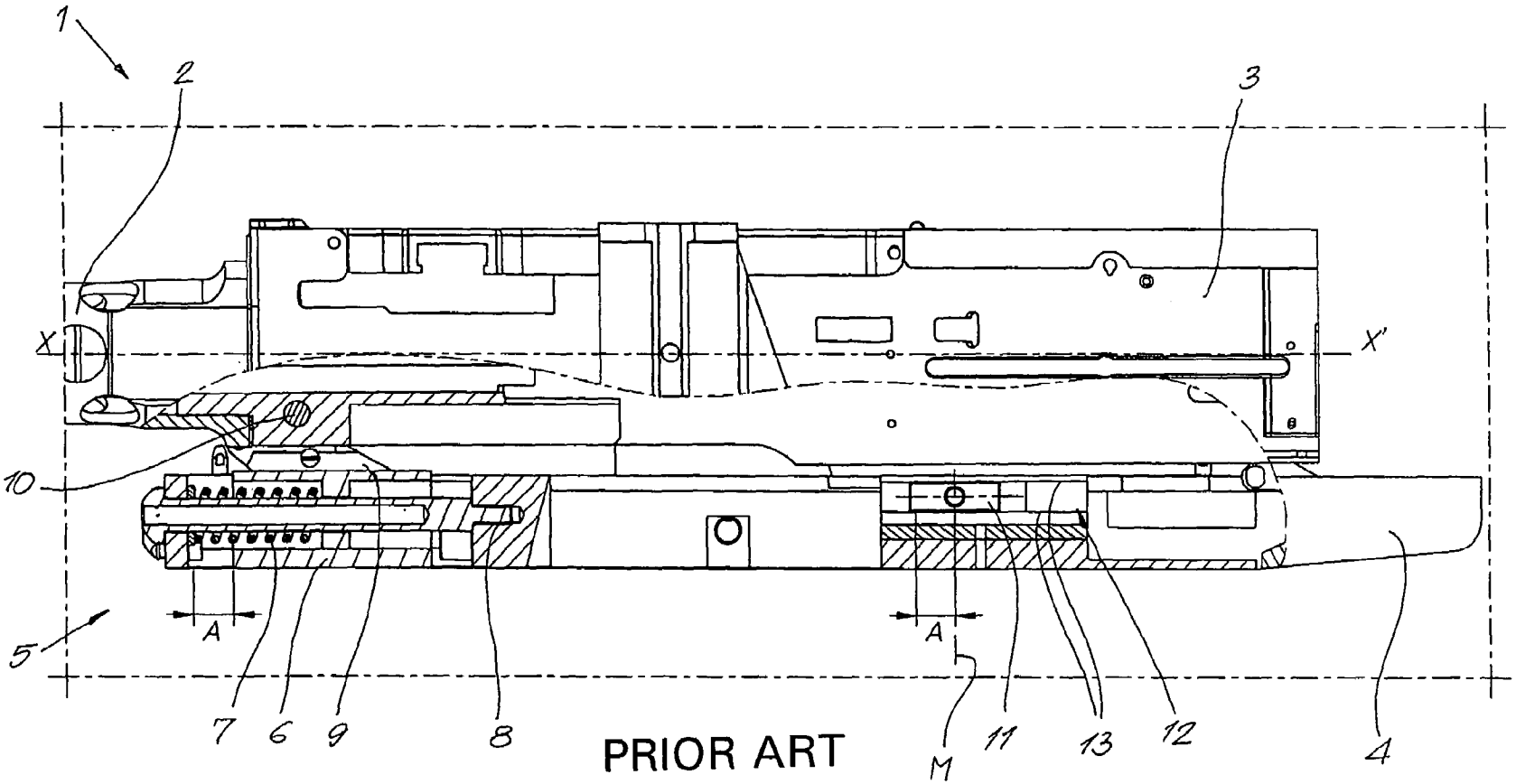
PRIOR ART Fig.2
FIG. 2 represents the part indicated by F2 in FIG. 1 to a larger scale.

According to a preferred embodiment, the ears 9 supporting the transversal hinge pin 10 are fixed to a non-represented supporting element, which is part of the slide 6 of the cradle 5, whereby this supporting element can swivel laterally around a pivot whose axis U-U' is perpendicular or mainly perpendicular to the transversal hinge pin 10 and the axis of the barrel X-X', as represented in FIGS. 3 and 4.

Figure 5:
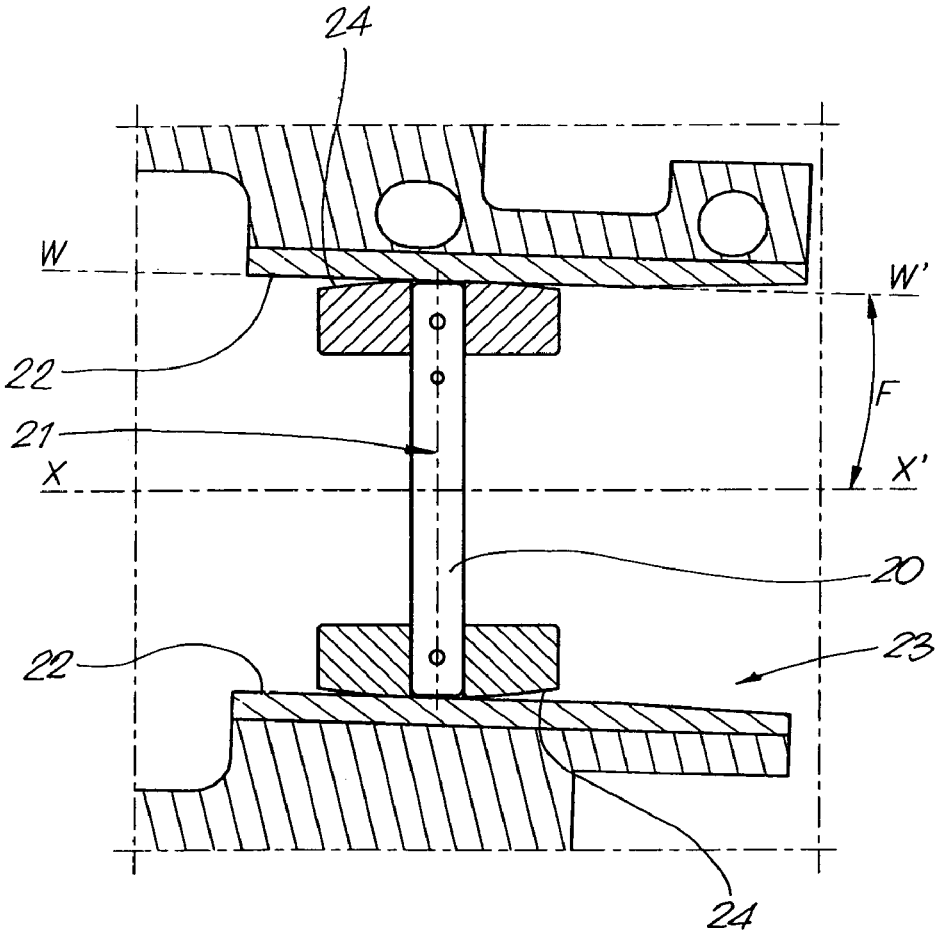
FIG. 5 is a section according to line V-V in FIG. 2, to a larger scale.

In the given example, two shoes 11 are interconnected by a rod 20 so as to form a single integrated piece 21, as illustrated in figure 5, whereby this piece is mounted between the guiding walls 13 of the first sliding guides 12 and between two vertical guiding planes 22 which are inclined at an angle F in relation to the axis X-X' of the barrel 2 so as to realize an additional, second sliding guide 23 serving as a guide for the shoes 11 in the lateral direction W-W'.

The effect of the second sliding guide 23 is that a recoil of the casing 3 results in a lateral shift of the muzzle of the barrel 2 while making the casing 3 and the barrel 2 swivel around the axis U-U' of the pivot of the supporting element of the hinge pin 10.

In the example of FIG. 5, the lateral surfaces 24 of the shoes 11 make contact with the guiding planes 22 and they have a bulged shaped.

The working of the fire arm 19 according to the invention differs from the working of the known fire arm 1 in that the recoil of the casing 3 and of the barrel 2 after the first salvo is translated in an inclination of the barrel 2, for example towards the bottom, and a lateral shift of the muzzle 2A of the barrel 2, for example to the right, due to the inclination of the sliding guides 12 and 23 in relation to the axis of the barrel X-X' in rest.

Figure 6:
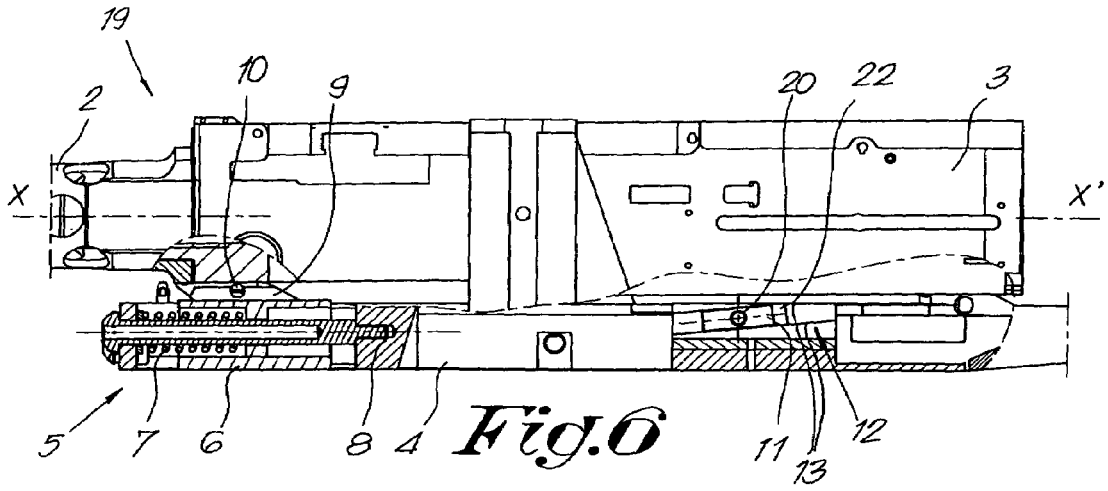
FIGS. 6 and 7 are views similar to those in FIG. 4, but for two different positions.
Figure 7:
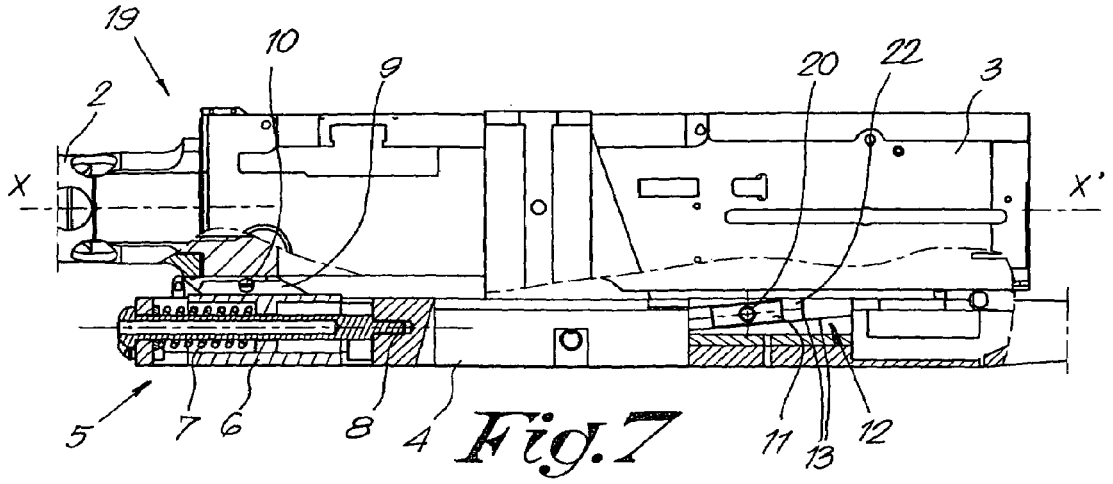

The inclination of the barrel 2 through the action of the propulsion gases is illustrated in FIGS. 4, 6 and 7.

FIG. 4 corresponds to the situation in rest, whereas FIGS. 6 and 7 respectively correspond to the position of the mobile elements after the first shot and the average position of the elements during a salvo.

FIGS. 6 and 7 clearly show that the recoil of the casing 3 makes the shoes 11 rise in the first sliding guides 12, which results in an inclination of the barrel 2 towards the bottom.

The inclination angles E and F of the first and second sliding guides 12 and 23 respectively in relation to the axis X-X' are selected such that the average point of impact 18 is reduced to the initial point of impact 14, whereby the vertical deviation C and the lateral deviation D are eliminated, as illustrated in FIG. 3.

In this manner, the accuracy of the salvo is considerably improved, as all the impacts are better gathered, including the initial impact 14 of the first shot and the impacts 16 of the successive shots of the salvo.

The invention is not limited to machine-guns, but it can also be applied to other automatic or semi-automatic fire arms that can fire by bursts.

It is clear that, instead of using shoes 11 which are integrated in a single piece 21, one can also use separate shoes to correct the salvo, for example in a vertical and a lateral direction.

It is not excluded to provide a firing correction exclusively in the vertical direction or exclusively in the lateral direction, depending on the type of fire arm.

The correction must not necessarily be situated in the vertical or horizontal plane.

It is also clear that, instead of the shoes 11, one can also use other guiding means, such as carriages, balls, etc.

As an option, one can provide an adjusting system to adjust the inclination of the first and second sliding guides 12 and 23 in relation to the axis X-X' of the barrel 2 so as to be able to correct the accuracy when firing by bursts and to reduce the average point of impact 18 to the point of impact 14.

It is not excluded that the fire arm 1 is not mounted directly on the frame, but through the intermediary of a fixing element.

In that case, the frame and said fixing element together form a device on which a fire arm can be mounted so as to improve the accuracy when firing by bursts with this fire arm.

The invention is by no means restricted to the above-described example; on the contrary, many modifications can be made to the above-described fire arm while still remaining within the scope of the invention as defined in the following claims.

The invention claimed is:

1. A firearm with improved salvo accuracy, comprising a barrel and a casing mounted on a supporting frame, the frame comprising a cradle provided with a slide slidable in a direction mainly parallel to the axis of the barrel, and the casing being mounted at a first end on the slide of the cradle on a transversal hinge pin, and at a second end on the frame via at least one shoe mounted in at least one sliding guide provided in the frame, and wherein said at least one sliding guide is inclined in relation to the direction of the axis of the barrel at rest.

2. The firearm according to claim 1, wherein a first sliding guide is located at a distance from the hinge pin of the casing.

3. The firearm according to claim 1, wherein the first sliding guide is configured such that a recoil of the casing and of the barrel on the frame is translated into an inclined swiveling of the barrel and of the casing around the hinge pin.

4. The firearm according to claim 3, wherein a guiding direction of the first sliding guide extends in a plane which is mainly perpendicular to the hinge pin of the casing.

5. The firearm according to claim 1, wherein the hinge pin is mounted in a supporting element forming part of the slide of the cradle and arranged to laterally swivel around a pivot whose axis is perpendicular or mainly perpendicular to the hinge pin and to the axis of the barrel.

6. The firearm according to claim 5, wherein a second sliding guide is configured such that a recoil of the casing and of the barrel on the frame is translated into a lateral swiveling of the casing and of the barrel around the axis of the pivot of the supporting element of the hinge pin.

7. The firearm according to claim 6, wherein a guiding direction of the second sliding guide lies in a plane mainly perpendicular to the pivot.

8. The firearm according to claim 5, including first and second sliding guides, each including a shoe supporting the casing, wherein the dimensions of the first and second sliding guides are such that a recoil of the casing and of the barrel on the frame is translated into an inclined swiveling of the barrel around the hinge pin of the casing and into a lateral swiveling around the axis of the pivot of the supporting element of the hinge pin.

9. The firearm according to claim 8, wherein a first guiding direction of the first sliding guide lies in a plane which is mainly perpendicular to the hinge pin of the casing, and a second guiding direction of the second sliding guide extends in a plane which is mainly perpendicular to pivot.

10. The firearm according to claim 8, wherein the shoe mounted in the first sliding guide and the shoe is mounted in the second sliding guide are integrated into a single piece.

11. The firearm according to claim 8, wherein the first and second sliding guides are integrated into a single piece.

12. The firearm according to claim 1, wherein the shoe comprises a lateral surface with a bulged shape.

13. The firearm according to claim 1, including an adjusting means to adjust the inclination angle of the at least one sliding guide in relation to the axis of the barrel at rest.

14. A device to improve the salvo accuracy for a firearm, comprising a fixing element for the firearm mounted on a supporting frame having a cradle provided with a slide slidable in a longitudinal direction parallel to the axis of the barrel, wherein the fixing element is mounted at a first end on the slide of the cradle on a transversal hinge pin, and at a second end on the frame via at least one shoe mounted in a sliding guide in the frame, wherein said sliding guide is inclined in relation to said longitudinal direction.

* * * * *